United States Patent [19]

Martin

[11] 4,046,579

[45] Sept. 6, 1977

[54] DISPOSABLE PATTERN COMPOSITION

[76] Inventor: Tom Martin, 50 W. Wrightwood, Glendale, Ill. 60137

[21] Appl. No.: 597,211

[22] Filed: July 18, 1975 (Under 37 CFR 1.47)

[51] Int. Cl.[2] ..... C08L 91/06

[52] U.S. Cl. ..... 106/38.8; 106/230; 106/270; 106/272; 260/27 R; 260/28.5 R; 260/45.95 R

[58] Field of Search ..... 106/38.35, 38.8, 270, 106/272, 230; 260/45.95 B

[56] References Cited

U.S. PATENT DOCUMENTS

| | | | |
|---|---|---|---|
| 2,692,835 | 10/1954 | Capell et al. | 106/270 |
| 2,829,175 | 4/1958 | Bowman et al. | 260/45.95 B |
| 2,881,151 | 4/1959 | Young et al. | 106/270 |
| 2,917,550 | 12/1959 | Dietzler | 260/45.95 B |
| 3,667,979 | 6/1972 | Merges | 106/38.8 |

OTHER PUBLICATIONS

Morawetz, "Phenolic Antioxidants for Paraffinic Mat'ls.", Ind. Eng. Chem., vol. 41, 1949, pp. 1442–1447.

*Primary Examiner*—Lorenzo B. Hayes
*Attorney, Agent, or Firm*—Dressler, Goldsmith, Clement, Gordon & Shore, Ltd.

[57] ABSTRACT

A disposable pattern material for investment casting processes incorporating 4,4'-isopropylidene diphenol and a thermoplastic material.

3 Claims, No Drawings

DISPOSABLE PATTERN COMPOSITION

BACKGROUND OF THE INVENTION

This invention relates to improved pattern materials, to improved disposable patterns especially made for use in investment casting processes, sometimes also known as lost wax processes, and to an improved investment casting process.

Investment casting processes have been used for centuries. Materials for making disposable patterns to be used in such processes are formulated for a number of properties, including important properties such as dimensional reproduceability and highly accurate surface finish in the molded disposable pattern. Because such properties are critically important to many products made by lost wax processes, continuing efforts are always underway to improve those properties of pattern materials, among others.

Virtually all of the properties of an investment casting depend upon the quality of the disposable pattern. These in turn depend upon the characteristics of the pattern forming materials from which disposable patterns are molded.

Disposable thermoplastic patterns are usually formed by heating and melting a thermoplastic pattern forming composition, introducing the molten composition into a mold, and then cooling the composition until it solidifies to form a disposable pattern. Thereafter, the disposable thermoplastic pattern is removed from the mold, is assembled if necessary with other patterns, and is then encased in a mold forming material, usually a ceramic material, in accordance with one of a variety of known methods, thereby to form a shell or cast about the disposable pattern. The disposable pattern is then removed, as by melting or vaporizing the pattern material, so that it leaves the shell or cast. Thereafter the shell or mold is ready for one-time use for forming an investment cast part. A text describing known procedures used in lost wax processes is entitled "Investment Casting," H. T. Bidwell, Machinery Publishing Co., Ltd., England, 1969.

It is apparent that the surface characteristics of the disposable pattern and of the ceramic shell are transferred, so to speak, to the final casting. It is also apparent that the pattern material and any residue therefrom will affect the surface characteristics and metallurgical characteristics of a casting. Similarly, it is clear that variations in expansion and contraction of compositions from which disposable patterns are formed will result in shells or casts of varying dimensions, which will then produce inconsistent castings. It is for such reasons that the properties of pattern materials are critical to the investment caster.

Many thermoplastic pattern materials have been used and have been suggested for use in the past. As the name "lost wax" process implies, true waxes, such as natural waxes, as beeswax and the like, were originally used as thermoplastic pattern materials. As other pattern materials were sought to improve the properties of disposable patterns, other natural thermoplastic materials, such as gum damar, gum rosin, esparto waxes, and the like, mineral waxes, such as those extracted from soft coal, and the like, and petroleum waxes were adopted for use. Subsequently, modified waxes, such as microcrystalline waxes, were developed for use and used in lost wax processes. More recently, synthetic thermoplastic materials, such as polystyrene, have been used as pattern materials, or as thermoplastic pattern forming composition modifiers as a result of the continuing efforts of researchers to improve upon and develop new thermoplastic materials. Those efforts have also resulted in the use by some investment casters of materials other than thermoplastic pattern materials, such as mixtures of metallic salts, mercury, among others.

Efforts have also been made to increase the dimensional accuracy and stability of thermoplastic pattern forming compositions by the addition of solid filler materials. Polystyrene powder and urea powder have been so used, and have been added in minor quantities to thermoplastic pattern-forming compositions. Organic acids, such as fumaric acid, adipic acid and isophthalic acid, have also sometimes been used as solid filler, usually in amounts of up to about 40% by volume of the thermoplastic pattern forming composition, and in a particle size generally in the range of about 175 to 250 mesh.

In U.S. Pat. No. 3,754,943, issued to Paul Solomon on Aug. 28, 1973, there is disclosed an investment casting composition and method in which cyanuric acid is used as a solid filler in a thermoplastic forming composition. This invention provides improved dimensional stability to the thermoplastic patterns. However, since the filler material is acidic in nature, particularly in the presence of condensed moisture, it tends to be corrosive at high temperatures and damaging to the mold.

U.S. patent application Ser. No. 297,352, filed by Paul Solomon on Oct. 13, 1972, now U.S. Pat. No. 3,887,382 discloses an investment casting composition and method in which decachlorobiphenyl is used as a solid filler in a thermoplastic pattern forming composition. This invention also provides improved dimensional stability to the thermoplastic patterns. However, the decachlorobiphenyl has a very high melting point, above 300° C., and tends to leave a residue in the mold which frequently requires burning off.

SUMMARY OF THE INVENTION

In accordance with my invention, the above-discussed problems are overcome by providing a thermoplastic pattern composition comprising an organic thermoplastic pattern material, and from about 5% to about 70% and preferably from about 20% to about 70% of finely divided 4,4'-isopropylidene diphenol by weight of the thermoplastic pattern forming composition. Such a composition produces disposable thermoplastic patterns for use in investment casting processes which have superior dimensional reproduceability and highly accurate surface finishes. Furthermore, the compositions do not induce corrosion or residue problems.

4,4'-isopropylidene diphenol in the amounts specified above, when added to pattern forming compositions containing waxes, such as true waxes, or containing thermoplastic resins used in lieu of waxes, produces thermoplastic disposable patterns which have a number of advantages, and which have improved characteristics, as compared to prior disposable thermoplastic patterns. The terms "organic thermoplastic material" or "thermoplastic material" are sommetimes used in this application to include waxes and resins frequently referred to as "waxes," such as polystyrene, and other presently useful or potentially useful "waxes" and natural and snynthetic thermoplastic resins, such as rosin and polystyrene, which are usable as the thermoplastic portion of a thermoplastic pattern forming composition incorporating 4,4'-isopropylidene diphenol.

When disposable patterns are formed or organic thermoplastic materials and finely divided 4,4'-isopropylidene diphenol, upon cooling, they shrink and contract considerably less than the thermoplastic material itself would shrink. Other improved properties result from the use of 4,4-isopropylidene diphenol in thermoplastic pattern forming compositions. For example, because 4,4'-isopropylidene diphenol is dimensionally and physically stable up to 150° C., a temperature considerably higher than the melting point of thermoplastic materials currently used to make disposable patterns, higher drying temperatures can be used during the application of ceramic coats to the thermoplastic patterns in the ceramic shell lost wax process. The use of higher temperatures speeds up quite considerably the shell making portion of such investment processes. Additionally, because 4,4'-isopropylidene diphenol melts at 150° C. it far exceeds the melting point of the thermoplastic material into which it is incorporated without being so high as to leave a difficultly removable residue. As such, the 4,4'-isopropylidene diphenol portion of the composition remains stable up to about 150° C., limiting the thermal expansion of the overall pattern, hence minimizing distortion of the pattern up to about 150° C. Further, 4,4'-isopropylidene diphenol is neither acid nor alkaline in its solid or liquid states, hence will not attack alkaline- or acid- sensitive ceramic materials.

Other advantages derived from the practice of this invention and of disposable patterns made in accordance with this invention will become apparent from the following description and examples.

The composition of this invention comprises a thermoplastic pattern material and 4,4,'-isopropylidene diphenol in amount of from 5% to about 70% by weight of the total thermoplastic pattern forming composition. For high quality castings, the particles should not exceed 100 mesh.

4,4'-isopropylidene diphenol, commonly called "Bisphenol-A," is a commercially available material used as a raw material in the manufacture of epoxy resins. It does not appreciably expand or shrink in a range from ambient room temperature to a temperature of 150° C. In pattern forming compositions 4,4'-isopropylidene diphenol is inert, hence it is not subject to shrinking upon cooling as are the lower melting thermoplastic portions of the thermoplastic pattern forming compositions.

Molecular weight: 228.28
Specific gravity: 1.195
Melting point: 150°-155° C.
Boiling point at (7.6mm): 230° C.

DETAILED DESCRIPTION

Compositions according to this invention have been formed into solid disposable patterns and have been tested, as shown in the examples which follow.

EXAMPLE 1

A thermoplastic pattern material was made by melting and mixing ingredients as follows until they were homogeneously dispersed as a single phase. The composition remained as a single phase on cooling and solidification.

| Ingredient | Parts by Weight |
|---|---|
| Terpene Polymer (115° C. m.p.) | 55 |
| Synthetic paraffinic mineral wax (200° C. m.p.) | 5 |
| Paraffin (59-60° C. m.p.) | 20 |
| Natural carnauba wax | 10 |
| Microcrystalline was (79-82° C. m.p.) | 10 |
| | 100 |

EXAMPLE 2

A mixture of 60 percent by weight of finely divided 4,4'-isopropylidene diphenol of between about 30 and about 40 microns in size and 40 percent by weight of the mixture of Example 1 was formulated. The 4,4'-isopropylidene diphenol was blended into the homogeneous melt of Example 1, but retained its particulate identity. The result was a two-phase system with the 4,4'-isopropylidene diphenol particles uniformly distributed throughout. The ball and ring softening points of solid body test patterns cast from the compositions of Examples 1 and 2 were quite close. However, the volumetric expansions of the test patterns were markedly different, and as will be apparent, the volumetric expansion characteristics of the test pattern of Example 2 was very markedly improved.

| | Volumetric Expansion (ASTM D-1168 Method B) | |
|---|---|---|
| Temperature ° F. | Example 1 | Example 2 |
| 70 | — | — |
| 75 | 0.6 | 0.6 |
| 80 | 1.4 | 1.0 |
| 85 | 3.3 | 1.5 |
| 90 | 2.0 | 1.6 |
| 95 | 2.2 | 1.9 |
| 100 | 2.8 | 1.9 |
| 105 | 2.4 | 2.4 |
| 110 | 3.0 | 2.6 |
| 115 | 3.4 | 3.1 |
| 120 | 4.0 | 3.3 |
| 125 | 5.3 | 3.6 |
| 130 | 5.6 | 3.8 |
| 135 | 7.2 | 4.1 |
| 140 | 7.7 | 4.3 |
| 145 | 8.8 | 4.4 |
| 150 | 9.7 | 4.3 |
| 155 | 10.4 | 4.6 |
| 160 | 10.7 | 4.8 |
| 165 | 11.7 | 5.1 |
| 170 | 12.0 | 5.3 |
| 175 | 13.0 | 5.6 |
| 180 | 13.2 | 6.0 |
| 185 | 14.1 | 6.1 |
| 190 | 14.5 | 6.3 |

The accuracy of that test method is considered to be about ±0.2%. The test results demonstrate a very substantial reduction in thermal expansion, a highly desirable property for disposable thermoplastic patterns.

It is also determined that the pattern of Example 2 was much less likely to break a ceramic cast when the pattern was eliminated. Additionally, the disposable pattern of Example 2 produced less residual ash and less erosion and wetting of the ceramic surface, thereby ultimately producing a casting having a more accurate surface finish. That is especially important in pattern removal processes where temperatures of as much as 1600° to 2000° F. (881° to 1093° C.) are utilized to eliminate wax and carbon.

Other compositions embodying the principles of this invention have been made. Disposable thermoplastic patterns formed from those compositions have demonstrated a reduction in ash content and a reduction in agitation caused by boiling and burning against the ceramic mold during de-waxing, and have also demonstrated improved reproduceability and surface finish characteristics.

Thermoplastic pattern forming compositions were blended, as indicated in Examples 1 and 2, of the following ingredients. The composition of Example 3 was a single-phase composition while those of Examples 4 and 5 were two-phase compositions.

EXAMPLE 3

| Ingredient | Parts by Weight |
|---|---|
| Triple pressed stearic acid | 40 |
| Cumar resin MH | 60 |
| | 100 |

The ash content of Example 3 was about 0.013% of the original volume.

EXAMPLE 4

| Ingredient | Parts by Weight |
|---|---|
| Mixture of Example 3 | 50 |
| Powdered 4,4'-isopropylidene diphenol (30–40 micron size) | 50 |
| | 100 |

The ash content of Example 4 was found to have been reduced to about 0.007% of the original volume.

EXAMPLE 5

| Ingredient | Parts by Weight |
|---|---|
| Mixture of Example 3 | 30 |
| Powdered 4,4'-isopropylidene diphenol (30–40 micron size) | 70 |
| | 100 |

The ash content of Example 5 was found to have been reduced to about 0.004% of the original volume.

In Examples 4 and 5, the surface finishes of castings cast from a disposable pattern of the compositions indicated were found to be substantially improved as compared to the surface finish of castings cast from a disposable pattern made from the composition of Example 3.

This invention is particularly useful when the thermoplastic pattern material is one of relatively high melting point, such as a melting point in excess of 130° C. When high temperature thermoplastic pattern materials, such as waxes, can be used to form patterns, they can speed the ceramic mold or cast forming step of an investment casting process because higher temperatures can be used to dry the ceramic shell or cast, thus decreasing the drying time. Higher melting thermoplastic materials also frequently exhibit greater dimensional stability, both at higher and lower temperatures, than do those lower temperature disposable pattern materials now in use, making the use of high temperature thermoplastic materials desirable. When 4,4'-isopropylidene diphenol is used as a filler, other thermoplastic materials which have relatively high melting points may be used when desired.

EXAMPLE 6

A high temperature thermoplastic pattern material was compounded, as stated above, from the following:

| Ingredient | Parts by Weight |
|---|---|
| Acrawax 'C' (140–143° C. m.p. Glyco Products) | 50 |
| Powdered 4,4'-isopropylidene diphenol (30 to 40 micron size) | 50 |
| | 100 |

This produced a two-phase thermoplastic pattern composition which was quite stable and which did not melt below about 140° C.

The high temperature characteristics of 4/4'-isopropylidene diphenol suggest other thermoplastic "waxes" which might now be used as thermoplastic pattern materials, or which may be more useful than heretofore thought. For example, polystyrene resins tend to expand upon heating to an extent frequently unacceptable for the production of high quality investment castings. By using a substantial fraction of finely divided 4,4'-isopropylidene diphenol, a significant enough reduction in the expansion of polystyrene pattern material may be realized to make polystyrene powders useful where they were not before. For example, a thermoplastic pattern forming composition comprising 50 parts by weight of a styrene-methyl styrene copolymer (such as Resin 24X Amoco Chemical Company) having a melting point of 114.4° C., and 50 parts by weight of 4,4'-isopropylidene diphenol is such a composition.

Other formulations, incorporating thermoplastic pattern materials not heretofore generally considered useful in lost wax processes which may now be advantageously considered for possible commercial use are the following. They may be blended to form two-phase systems in the manner indicated above.

EXAMPLE 7

| Ingredient | Parts by Weight |
|---|---|
| Crystalline Polyolefin resin, 131° C. m.p. | 50 |
| Powdered 4,4'-isopropylidene diphenol (30 to 40 micron size) | 50 |
| | 100 |

EXAMPLE 8

| Ingredient | Parts by Weight |
|---|---|
| Ethylene isobutyl acrylate copolymer, 121° ± 14° C. | 60 |
| Powdered 4,4'-isopropylidene diphenol (30 to 40 micron size) | 40 |
| | 100 |

EXAMPLE 9

| Ingredient | Parts by Weight |
|---|---|
| Ethylene ethyl acrylate copolymer, 82° C. m.p. | 75 |
| Powdered 4,4'-isopropylidene diphenol (30 to 40 micron size) | 25 |
| | 100 |

EXAMPLE 10

| Ingredient | Parts by Weight |
|---|---|
| Microcrystalline wax, 88–91° C. m.p. | 50 |
| Powdered 4,4'-isopropylidene diphenol (30 to 40 micron size) | 50 |
| | 100 |

Other thermoplastic pattern materials which produce improved thermoplastic patterns because of the presence of 4,4'-isopropylidene diphenol are those in Examples 11 and 12.

EXAMPLE 11

| Ingredient | Parts by Weight |
|---|---|
| Candellila wax | 40 |
| Alpha-terpene resin (125° C. m.p.) | 40 |
| Paraffin (57–60° C. m.p.) | 20 |
| Powdered 4,4'-isopropylidene diphenol (30 to 40 micron size) | 40 |
| | 140 |

EXAMPLE 12

| Ingredient | Parts by Weight |
|---|---|
| Paraffin (59–60° C. m.p.) | 4 |
| Beeswax | 10 |
| Gum damar | 7 |
| Carnauba wax | 20 |
| Cumar resin (60° C. m.p.) | 49 |
| Polyethylene | 10 |

-continued

| Ingredient | Parts by Weight |
|---|---|
| Powdered 4,4'-isopropylidene diphenol (30 to 40 micron size) | 40 |
| | 140 |

It is clear that this invention provides improved disposable thermoplastic pattern forming materials and improved disposable patterns, i.e., solid bodies of any predetermined shape, and consisting of a two-phase system in which the fine 4,4'-isopropylidene diphenol particles are uniformly distributed. It provides an improved method of investment casting in which disposable patterns are formed of compositions of this invention, and are then invested, as in ceramic or a refractory or the like, to form an improved cast.

Other thermoplastic pattern forming compositions will become apparent to those skilled in the art from the foregoing.

What is claimed is:

1. In a thermoplastic pattern forming composition comprising a thermoplastic pattern material, the improvement comprising a thermoplastic pattern forming composition having two phases containing, in admixture, said pattern material and finely divided 4,4'-isopropylidene diphenol not exceeding 100 mesh in an amount of from about 20% to about 70% by weight of the pattern forming composition.

2. A thermoplastic pattern forming composition in accordance with claim 1 in which said pattern material is a true wax.

3. A thermoplastic pattern forming composition in accordance with claim 1 in which said thermoplastic pattern material is a polystyrene resin.

* * * * *